US005083771A

United States Patent [19]

Tyner

[11] Patent Number: 5,083,771

[45] Date of Patent: Jan. 28, 1992

[54] NOVELTY ITEM

[76] Inventor: Michael R. Tyner, 3608 Pacific Ave., Marina Del Ray, Calif. 90292

[21] Appl. No.: 509,143

[22] Filed: Apr. 16, 1990

[51] Int. Cl.[5] ..... B64B 1/50

[52] U.S. Cl. ..... 272/27 N; 272/8 N; 40/412; 446/220; 116/DIG. 9

[58] Field of Search ..... 272/8 N, 27 N, 27 R, 272/8 R; 116/210, DIG. 8, DIG. 9; 40/214, 215, 220, 412; 446/220

[56] References Cited

U.S. PATENT DOCUMENTS 3,754,731 8/1983 Mackal et al. .

4,524,885 6/1985 Zimmerly .

4,903,958 2/1990 DiCarlo et al. ..... 272/8 N X 4,920,674 5/1990 Shaeffer ..... 116/210 X

*Primary Examiner*—Richard E. Chilcot, Jr.

*Attorney, Agent, or Firm*—Frederic P. Smith

[57] ABSTRACT

A novelty item in which an inflatable object is secured in a deflated state in a container with a movable lid. Inflation means is provided to rapidly expand the inflatable object beyond the bounds of the container. When the inflation means is actuated, the inflatable object rapidly expands thus causing the lid to move to an open position and a fully inflated object is suddenly thrust into view.

3 Claims, 1 Drawing Sheet

FIG. 1
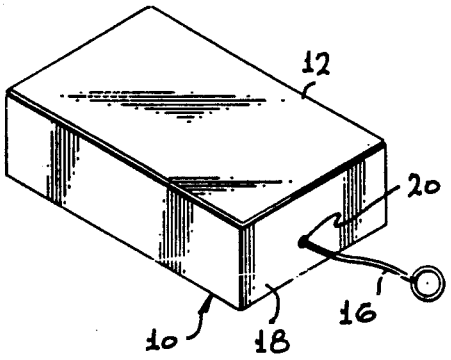
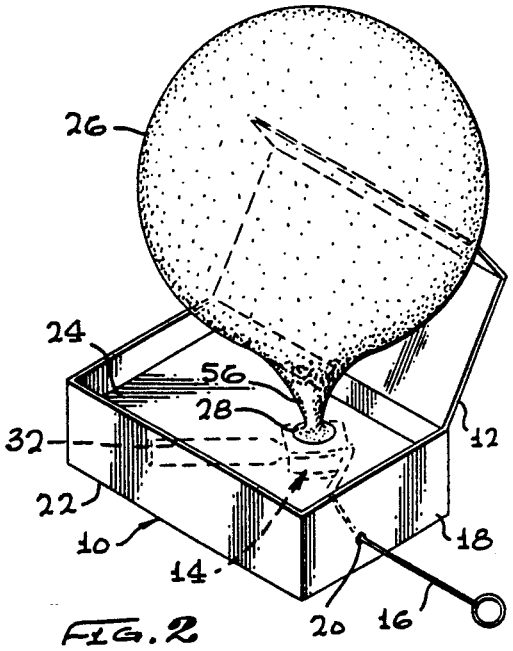
FIG. 2
FIG. 3
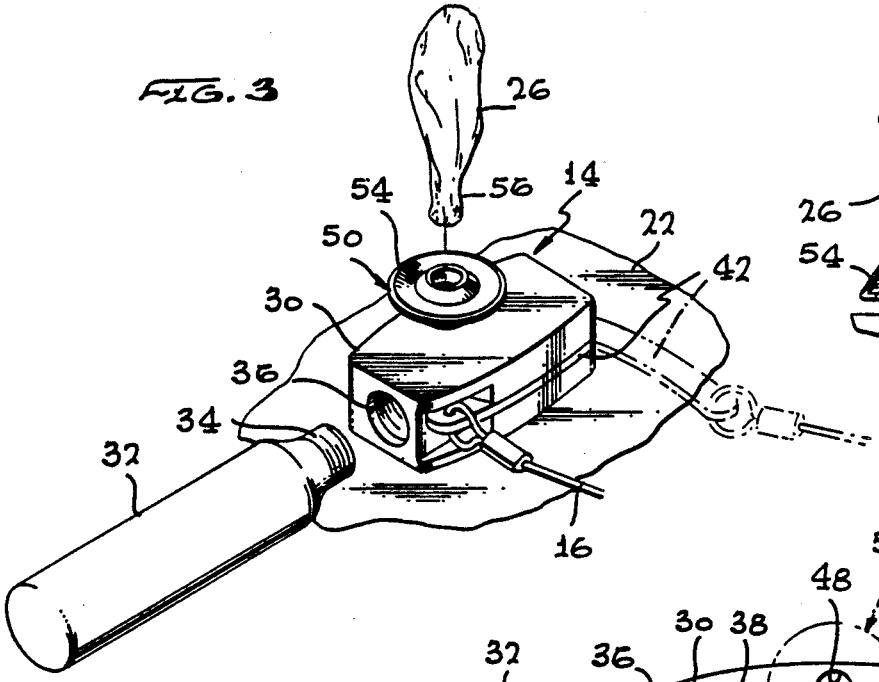
FIG. 5
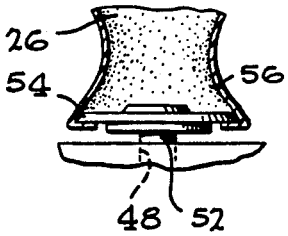
FIG. 4
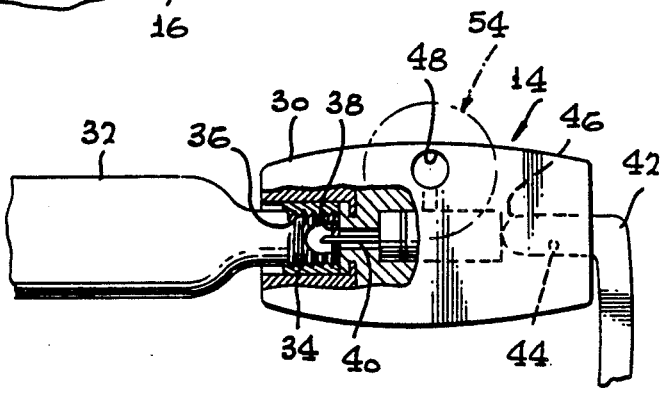

NOVELTY ITEMBACKGROUND OF THE INVENTION

1. Field of the Invention

The invention relates to the field of novelty items and, in particular, to a novelty item in which a concealed deflated object is rapidly expanded and suddenly thrust into view.

2. Description of Related Art

In the field of novelty items, the elements of surprise often play a major factor in entertaining the public. These elements are generally aural or visual, such as the unexpected loud sound of a firecracker or the sudden appearance of a jack-in-the-box. In addition to the element of surprise, however, it is desirable that the visual object be able to stimulate the viewer by its appearance, such as shape, color, size, variety, etc. This is typified by multicolored items popping out of box when the lid is removed, such as streamers, confetti and snakes. In general, however, the shape and size of the visual object is constrained by the size and configuration of the container in which it is enclosed while the element of surprise is constrained by the mechanism which thrusts the object out of the container or the inherent expansion properties of a compressed object, such as the spring in a jack-in-the-box or the foam plastic in snakes.

Thus, it is a primary object of the present invention to provide a new novelty item.

It is another object of the present invention to provide a novelty item which engenders a high element of surprise.

It is a further object of the present invention to provide a novelty item in which a large object of a selected configuration is suddenly thrust into view from a relatively small container.

SUMMARY OF THE INVENTION

A novelty item is provided in which an inflatable object is secured in a deflated condition in a container with a movable lid. Inflation means is coupled to the inflatable object to rapidly expand the inflatable object beyond the bounds of the container. When the inflation means is activated, the inflatable object rapidly expands, thus causing the lid to move to an open position and a fully inflated object is suddenly thrust into view.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 1 is a perspective view of the present invention in a closed configuration.

FIG. 2 is a perspective view of the present invention in an open configuration showing in phantom the inflation means.

FIG. 3 is a perspective view of the inflation means of the present invention.

FIG. 4 is a partial cut-away view of the inflation means of FIG. 3.

FIG. 5 illustrates the coupling between the inflation means and the inflatable object of the present invention.

DESCRIPTION OF THE PREFERRED EMBODIMENT

Referring now to FIGS. 1 and 2, the invention is shown in its closed and open positions. A container 10 with an openable lid 12 has an inflation means 14, shown in phantom in the lower portion of the container 10. drawstring 16 is connected to the inflations means 14 and exits the side 18 of the container 10 through ah aperture 20. The inflation means 14 can be secured either to the bottom 22 of the container 10 or to divider 24 positioned in the container 10. An inflatable object 26, shown here as a balloon, is coupled to the inflation means 14 through aperture 28 in the divider 24. The inflatable object 26, shown in a deflated state in FIG. 3, is contained in the portion of the container 10 above the divider 24 and is concealed from view by the lid 12, which lid 12 is secured in the closed position of FIG. 1 by a force fit or by a small amount of adhesive. When the drawstring 16 is pulled, the inflation means 14 causes the inflatable object 26 to rapidly expand, forcing open the lid 12 and presenting itself suddenly into view.

In FIGS. 3, 4 and 5 a preferred embodiment of the inflation means 14 is illustrated. The inflation means 14 is more thoroughly described in U.S. Pat. No. 4,524,885 "Break-Away Inflator" and U.S. Pat. No. 3,754,731 entitled "Inflation Manifold and Valve and Flange Assembly", which are incorporated herein by reference. The inflation means 7 14 consists of an inflator body 30, procurable from Roberts Valves of St. Petersburg, Fla., Part No. 840AM, which has a compressed gas cartridge 32, such as a #503 18 gram $CO_2$ cartridge procurable from Sparklet Devices, St. Louis, Mo., screwed into the body 30, the externally threaded neck 34 of the cartridge 32 being received within an internally threaded insert 36 molded into the body 30. A frangible seal 38 is disposed across the neck of the cartridge 32, such seal 38 being pierced by the sharpened forward end of a piercing pin 40 when the piercing pin 40 is thrust into the seal 38 and then withdrawn- by the mechanism of the inflator means 14, as more fully described in the above-referenced patent. The piercing pin 40 is actuated by the pivotal movement of lever 42 around pivot pin 44 affixed to the body 30 causing the surface of cam 46 to actuate the piercing pin 40 whenever lever 42 is caused to pivot by the pulling of the drawstring 16 coupled thereto. The body 30 has a passage 48 into which is inserted manifold 50, procurable also from Roberts Valves, Part No. 830 AOE, consisting of a valve 52 and a flange 54 around which the neck 56 of inflatable object 26 is secured. The construction of manifold 50 is more fully described in the above-referenced patent. Thus, upon actuation of the drawstring 16, the frangible seal 38 of the gas cartridge 32 is pierced causing the compressed gas to flow through passage 48 and the manifold 50 into the inflatable object 26. The object 26 then rapidly inflates, opening the lid 12 and thrusting itself suddenly into view.

It should be noted that the gas cartridge 32 can be filled with a pressurized gas other than $CO_2$, such as $N_2$ $He_2$ or even air, and that while bottle compressed gas is preferable other sources of gas for inflation could be used, such as could be produced by heating sublimable or ignitable materials to produce a rapid production of gas. In addition, the inflator body 30 need not have the punctuating mechanism described, but merely a mechanism to contain the gas within the cartridge 32 and suddenly release it when actuated, or to heat a sublimable or ignitable material to rapidly produce a gas, and transfer it to the inflatable object 26. An example of such a mechanism is the pressure valve on an oxygen or propane gas bottle but with, for example, an electromagnetic solenoid which can be actuated by the drawstring 16 or by a pressure sensitive button on the side 18 of, or inside the side 18 of, the container 16 or even by a remote transmitter. Furthermore, the inflatable object 26 while shown as a balloon can take any desirable shape, such as a birthday or other greeting or message or a fanciful figure, and can be inflated to almost any size depending on the size and pressure of the gas cartridge 32. Finally, the openable, secured lid 12 could be replaced by a tissue covering the container 10 which would be ruptured by the sudden expansion of the inflatable object.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims. Industrial Applicability The invention has applicability to the novelty item industry.

I claim:

1. A novelty item comprising:

an inflatable object;

container means adapted to contain said inflatable object in a deflated state; and inflation means adapted to act on said inflatable object for causing said inflatable object to rapidly expand beyond the bounds of said container means, said inflation means including a high pressure gas container and valve means coupled to said gas container, said valve means being adapted to cause the rapid release of said gas into said inflatable object upon the actuation thereof.

2. The novelty item of claim 1, wherein said valve means is adapted to puncture said gas container and said inflation means further includes actuation means coupled to said valve means to cause said valve means to puncture said gas container.

3. The novelty item of claim 1, wherein said inflation means further includes means for coupling said valve means to said inflatable object.

* * * * *